US005693921A

United States Patent [19]

Miller et al.

[11] Patent Number: 5,693,921

[45] Date of Patent: Dec. 2, 1997

[54] CONTINUOUS LINEAR CONTACT SWITCH AND METHOD OF ASSEMBLING SAME

[75] Inventors: Norman K. Miller, West Grove; Gevork Sarkisian, Philadelphia, both of Pa.

[73] Assignee: Miller Edge, Inc., West Grove, Pa.

[21] Appl. No.: 725,788

[22] Filed: Oct. 4, 1996

[51] Int. Cl.[6] ..... E05F 15/02

[52] U.S. Cl. ..... 200/5 A

[58] Field of Search ..... 49/27, 26, 28, 49/25; 200/61.43, 86 R, 86 A, 5 A

[56] References Cited

U.S. PATENT DOCUMENTS

| | | | |
|---|---|---|---|
| 3,732,384 | 5/1973 | Fischel | 200/86 R |
| 3,812,313 | 5/1974 | Wolf et al. | 200/86 R |
| 3,896,590 | 7/1975 | Miller | 49/488 |
| 4,051,336 | 9/1977 | Miller | 200/61.43 |
| 4,066,851 | 1/1978 | White et al. | 200/5 A |
| 4,080,519 | 3/1978 | Michalson | 200/86 R |
| 4,349,710 | 9/1982 | Miller | 200/61.43 |
| 4,620,072 | 10/1986 | Miller | 200/81 R |
| 4,908,483 | 3/1990 | Miller | 200/61.43 |
| 5,066,835 | 11/1991 | Miller et al. | 200/61.43 |
| 5,079,417 | 1/1992 | Strand | 250/221 |
| 5,259,143 | 11/1993 | Mitchell et al. | 49/27 |

*Primary Examiner*—Aditya Krishnan

*Attorney, Agent, or Firm*—Panitch Schwarze Jacobs & Nadel, P.C.

[57] ABSTRACT

A continuous linear contact switch is provided. The continuous linear contact switch includes first and second resilient strips, each having first and second longitudinal edges, an outer surface and an inner surface. The respective first and second longitudinal edges of the first and second resilient strips are joined to each other at first and second seams along an entire longitudinal length thereof. Beads are located along the seams on the inner surfaces of the first resilient strip so that the first resilient strip remains generally flat and the second resilient strip is arched to form an inner cavity between the generally flat first resilient strip and the arched second resilient strip. A first flexible, electrically conductive strip is located on the inner surface of the first resilient strip. A second flexible, electrically conductive strip is located along the inner surface of the second resilient strip, spaced from the first flexible, electrically conductive strip.

10 Claims, 2 Drawing Sheets

CONTINUOUS LINEAR CONTACT SWITCH AND METHOD OF ASSEMBLING SAME

FIELD OF THE INVENTION

The present invention relates to a contact switch, and more particularly, to a linear contact switch which can be formed in continuous lengths and can then be cut to a desired length for a particular application.

BACKGROUND OF THE INVENTION

The use of force-sensing linear contact switches is generally known in the art. Such linear contact switches are used in many applications for activating a signal from any point in proximity to the linear contact switch. One application for linear contact switches is in mass transit vehicles where the linear contact switches are installed along the length of the vehicle adjacent to the passenger seating area such that the passengers can press a portion of the linear contact switch to signal the operator.

One known linear contact switch is formed from two conductive strips of metal which are encased in a polymeric sheath with a resilient foam spacer member being located at regularly spaced intervals between the metal strips to maintain a predetermined distance or gap between the conductive strips. When the outside of the sheath is pressed on, the resilient foam spacer member is compressed allowing the two conductive metal strips to contact each other in the areas between the resilient foam spacer members. However, if the polymeric sheath is pressed in an area where a resilient foam spacer is located, the switch may not actuate. Additionally, if the contact switch is bent sharply or crimped during shipping or installation, the conductive metal strips can become permanently deformed in a position with the strips in contact with each other.

In another known continuous linear contact switch, two conductive metallic strips are molded into opposite inner sides of a polymeric sheath. The opposite inner sides of the sheath are generally parallel to each other and the resiliency of the polymeric sheath material maintains a gap between the contact strips. However, the contact strips can become easily distorted when the linear contact switch is cut to length. If the contact switch is bent or deformed during shipping, portions of the contact strips could remain in contact with each other.

The present invention is a result of observation of the foregoing and other limitations of the prior art devices and efforts to solve them.

SUMMARY OF THE INVENTION

Briefly stated, the present invention is a continuous linear contact switch. The continuous linear contact switch comprises first and second resilient strips, each having first and second longitudinal edges, an outer surface and an inner surface. The respective first and second longitudinal edges of the first and second resilient strips are joined to each other at first and second seams along an entire longitudinal length thereof. Beads are located along the seams on the inner surfaces of the first resilient strip so that the first resilient strip remains generally flat and the second resilient strip is arched to form an inner cavity between the generally flat first resilient strip and the arched second resilient strip. A first flexible, electrically conductive strip is located on the inner surface of the first resilient strip. A second flexible, electrically conductive strip is located along the inner surface of the second resilient strip.

In another aspect, the present invention provides a continuous linear contact switch having first and second resilient strips. The first and second resilient strips each have first and second longitudinal edges, an outer surface and an inner surface. The respective first and second longitudinal edges of the first and second resilient strips are connected to each other along an entire longitudinal length thereof. Beads are located on the inner surface of the first resilient strip along the first and second longitudinal edges adjacent to the first and second longitudinal edges of the second resilient strip. The second resilient strip is arched to form an inner cavity between the first and second resilient strips with the beads being located inside the cavity and maintaining a gap between the first and second resilient strips. A first flexible, electrically conductive strip is located on the inner surface of the first resilient strip and a second flexible, electrically conductive strip is located along the inner surface of the second resilient strip. The beads maintain a gap between the first and second flexible, electrically conductive strips.

The present invention also provides a method for assembling a continuous linear contact switch comprising the steps of:

- locating a portion of a first strip of resilient material, having first and second longitudinal edges, an outer surface and an inner surface, with a first strip of flexible, electrically conductive affixed to the inner surface, on a first side of a mandrel;
- locating a portion of a second strip of resilient material, having first and second longitudinal edges, an outer surface and an inner surface, with a second strip of flexible, electrically conductive affixed to the inner surface of the second strip, on a second side of the mandrel;
- joining the first and second longitudinal edges of the portion of the first longitudinal strip located on the first side of the mandrel with the respective first and second edges of the portion of the second longitudinal strip located on the second side of the mandrel to form a portion of a continuous linear contact switch;
- sliding the portion of the continuous linear contact switch off of the mandrel; and
- locating additional portions of the first and second continuous resilient strips on the first and second sides of the mandrel and joining the respective first and second longitudinal edges together to form a continuous linear contact switch of a desired length.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 5B:
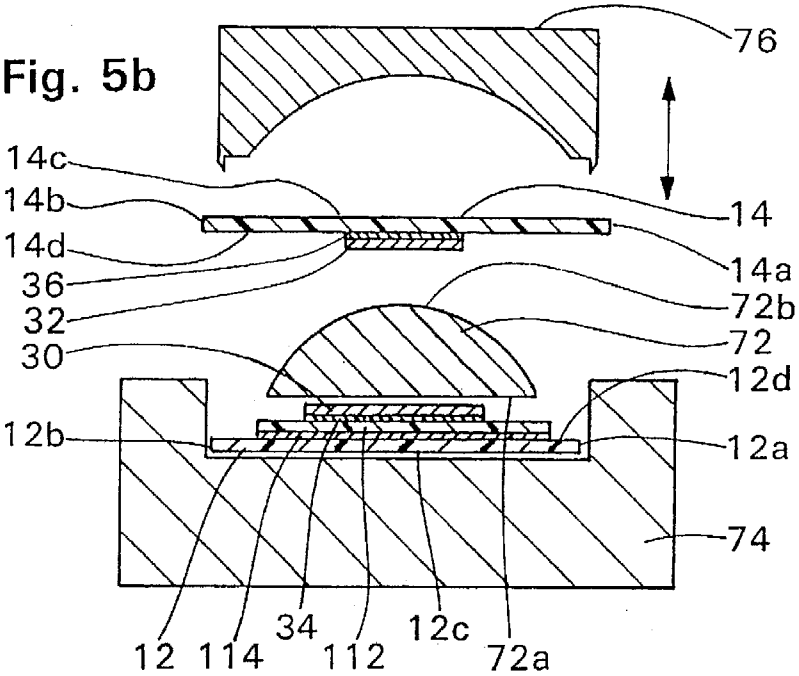
FIG. 5*b* is a cross-sectional view taken along line 5—5 in FIG. 4 of the second embodiment of the linear contact switch shown in FIG. 2 during assembly.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the continuous linear contact switch in accordance with the present invention or the apparatus for making the continuous linear contact switch and designated parts thereof. The terminology includes the words above specifically mentioned, derivatives thereof and words of similar import.

Referring to the drawings, wherein like numerals indicate like elements throughout, there is shown in FIGS. 1, 3, 4 and 5*a* a first preferred embodiment of a continuous linear contact switch 10 in accordance with the present invention.

Figure 1:
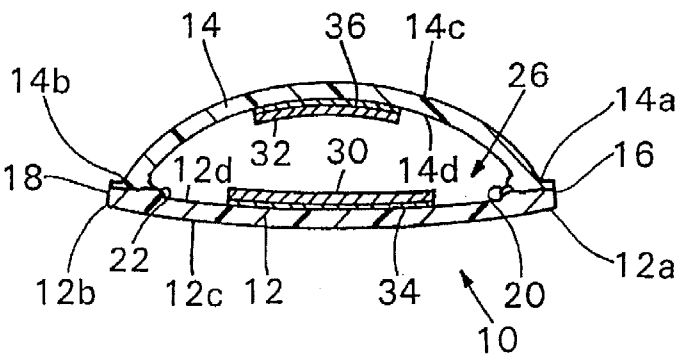
FIG. 1 is a cross-sectional view of a first embodiment of a linear contact switch in accordance with the present invention.

Referring now to FIG. 1, the first embodiment of the linear contact switch 10 is shown. The linear contact switch 10 includes first and second resilient strips 12 and 14, with each strip having first and second longitudinal edges 12*a*, 12*b* and 14*a*, 14*b*, respectively. The first resilient strip has an outer surface 12*c* and an inner surface 12*d*, and the second resilient strip has an outer surface 14*c* and an inner surface 14*d*. The respective first and second longitudinal edges 12*a*, 14*a* and 12*b*, 14*b* of the first and second resilient strips 12 and 14 are joined to each other at first and second seams 16 and 18, respectively, along an entire longitudinal edge of the first and second resilient strips 12, 14.

Preferably, the first and second resilient strips 12, 14 are made of a polymeric material such as polyvinyl chloride (PVC). The strip 12 can also be made of a rigid strip of PVC. In that case the exterior of the switch 10 would have the same profile as the switch 110, described in detail below. However, it would be understood by those skilled in the art that other suitable polymeric materials such as rubber or neoprene may be used, if desired, depending upon the particular application. Preferably, the first and second seams 16 and 18 are formed by a radio frequency (RF) seal which forms a bond by applying high frequency vibration and pressure on the areas of the first and second resilient strips 12, 14 to be joined. RF seals are generally known to those skilled in the art and, accordingly, further description of RF sealing is not believed to be necessary. However, it will be understood by those skilled in the art that the first and second seams can be made by various means, such as heat sealing, an adhesive connection, or any other suitable joining method, depending upon the material being joined.

Referring again to FIG. 1, beads 20 and 22 are located along the seam 16 and 18 on the inner surface 12*d* of the first resilient strip 12. The beads 16, 18 are located such that the first resilient strip 12 remains generally flat and the second resilient strip 14 is arched. This forms an inner cavity 26 between the generally flat first resilient strip 12 and the arched second resilient strip 14.

In the first preferred embodiment, pre-formed beads 20, 22 are located along the entire length of each of the first and second longitudinal edges 12*a*, 12*b* of the first resilient strip 12. However, it would be recognized by those skilled in the art that the beads 20, 22 may be located at spaced intervals along the first and second longitudinal edges 12*a*, 12*b*. It will be similarly recognized from the present disclosure that the beads 20, 22 may be formed during the steaming process from material which is displaced inwardly from both the first and second resilient strips 12 and 14 as the seams 16, 18 are being 25 formed. Material from the first and second resilient strips 12 and 14 will extrude inwardly into the cavity 26 due to the clamping force between the ends of the seal bar 76 and the support track 73, as explained in detail below, and form a bead along each seam 16, 18, particularly if the seams 20 and 22 are formed by a heat seal or an RF seal. It will also be recognized by the skilled artisan that the first and 5 second resilient strips 12, 14 may be formed as a single piece by an extrusion process with the beads 20, 22 being located on the inner surfaces 12*d*, 14*d* of the first and second resilient strips 12 and 14 adjacent to the first and second longitudinal edges 12*a*, 14*a* and 12*b*, 14*b*.

A first flexible, electrically conductive strip 30 is located on the inner surface 12*d* of the first resilient strip 12. A second flexible, electrically conductive strip 32 is located along the inner surface 14*d* of the second resilient strip 14. Preferably, the first and second strips of flexible, electrically conductive material 30 and 32 are constructed from thin aluminum or aluminum foil with or without foam on the back side. However, it is within the scope of the present invention to construct the first and/or second flexible, electrically conductive strips 30, 32 of any other suitable flexible, electrically conductive material, such as copper, brass or an electrically conductive flexible plastic or a foil or a metallic coating on a woven cloth material.

Preferably, the first and second flexible, electrically conductive strips 30, 32 are attached to the inner surfaces 12*d*, 14*d* of the first and second resilient strips 12, 14 with adhesive layers 34, 36, respectively. The adhesive layers 34, 36 may be provided on separate carrier scrim cloth, or the first and second flexible, electrically conductive strips 30, 32 may be provided with an adhesive layer on one side.

Those skilled in the art will recognize that the first resilient strip 12 may be slightly deflected due to the flexural load created by the second resilient strip 14. However, the first resilient strip 12 is relatively flat in comparison to the second resilient strip 14.

In use, the continuous linear contact switch 10 is cut to a desired length for a particular application and is held in place by a suitable support member, such as a C-channel (not shown), in a manner known to those of ordinary skill in the art. Alternatively, the continuous linear contact switch 10 may be held in place by an adhesive material on the outer surface 12*c* of the first resilient strip 12, or by any other suitable means. Conductors (not shown) are attached to the first and second flexible, electrically conductive strips 30 and 32, and are preferably electrically connected to a device which is to be activated by the continuous linear contact switch 10. When a user presses on the outer surface 14*c* of the second resilient strip 14, the second resilient strip 14 is deflected toward to the first resilient strip 12 with the second flexible, electrically conductive strip 32 on the inner surface 14*d* of the second resilient strip 14 contacting the first flexible, electrically conductive strip 30 located on the inner surface 12*d* of the first resilient strip 12 to form an electrical connection. After contact is made between the first and second flexible, electrically conductive strips 30, 32 and the device (not shown) is signaled, the user releases the continuous linear contact switch 10. The second resilient strip 14 because of its "memory" returns to its arched position such that a space or gap is again provided between the first and second flexible, electrically conductive strips 30, 32.

Figure 2:
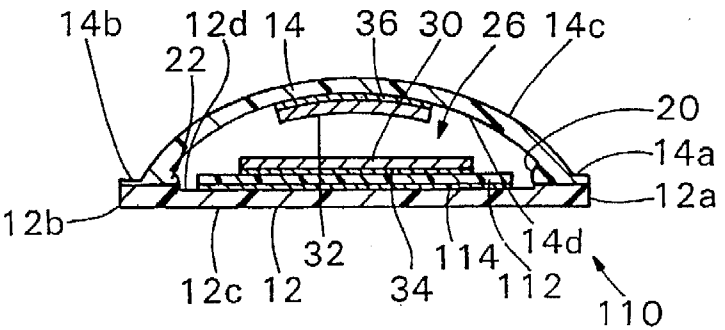
FIG. 2 is a cross-sectional view of a second embodiment of a linear contact switch in accordance with the present invention.

Referring now to FIG. 2, a second preferred embodiment 110 of a linear contact switch in accordance with the present invention is shown. The linear contact switch 110 is substantially the same as the first embodiment of the linear contact switch 10 and the same element numbers have been used to designate similar elements. The differences from the first embodiment of the linear contact switch 10 are explained in detail below.

Still with reference to FIG. 2, the linear contact switch 110 includes a stiffening member 112 located between the first flexible, electrically conductive strip 30 and the first resilient strip 12. Preferably, a third layer of adhesive 114 is located between the stiffening member 112 and the inner surface 12*d* of the first resilient strip 12. Preferably, the first flexible, electrically conductive strip 30 is attached to the stiffening member 112 by the first layer of adhesive 34. In the second preferred embodiment, the beads 20, 22 are formed during the seaming of the first and second longitudinal edges 12*a*, 14*a* and 12*b*, 14*b*, and are not pre-formed on the first strip of resilient material 12.

Preferably, the stiffening member 112 is made of a fiberglass reinforced strap and is used to maintain the first resilient strip 12 relatively flat to prevent bowing due to the preload caused by the arched second resilient strip 14. Those skilled in the art will recognize that the stiffening member 112 could be made of any other suitable metallic or polymeric material, depending upon the particular application.

A method of constructing a continuous linear contact switch 10, 110 in accordance with the first and second preferred embodiments of the present invention is described below in conjunction with FIGS. 3, 4, 5*a* and 5*b*. The assembly methods for the first and second embodiments 10, 110 of the continuous linear contact switch are very similar, except in the second preferred embodiment, the stiffening member 112 is introduced into the process along with another layer of adhesive material, and the beads 20, 22 are formed during the seaming process. Accordingly, the process will be described with reference to the first preferred embodiment of the continuous linear contact switch 10, and the additional steps required to incorporate the stiffening member 112 of the second preferred embodiment of the linear contact switch 110 will be noted separately.

Figure 5A:
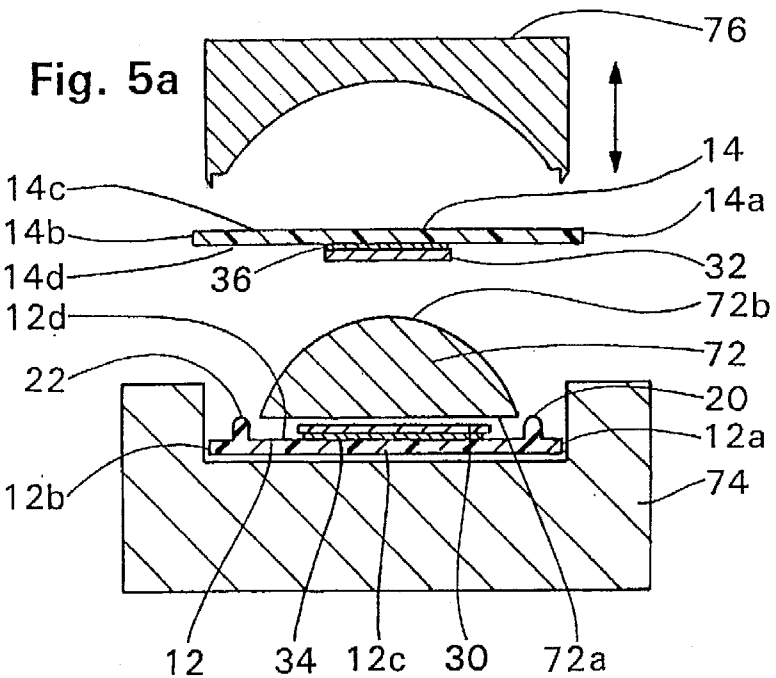
FIG. 5*a* is a cross-sectional view taken along line 5—5 in FIG. 4 of the first embodiment of the continuous linear contact switch shown in FIG. 1 during assembly.
Figure 3:
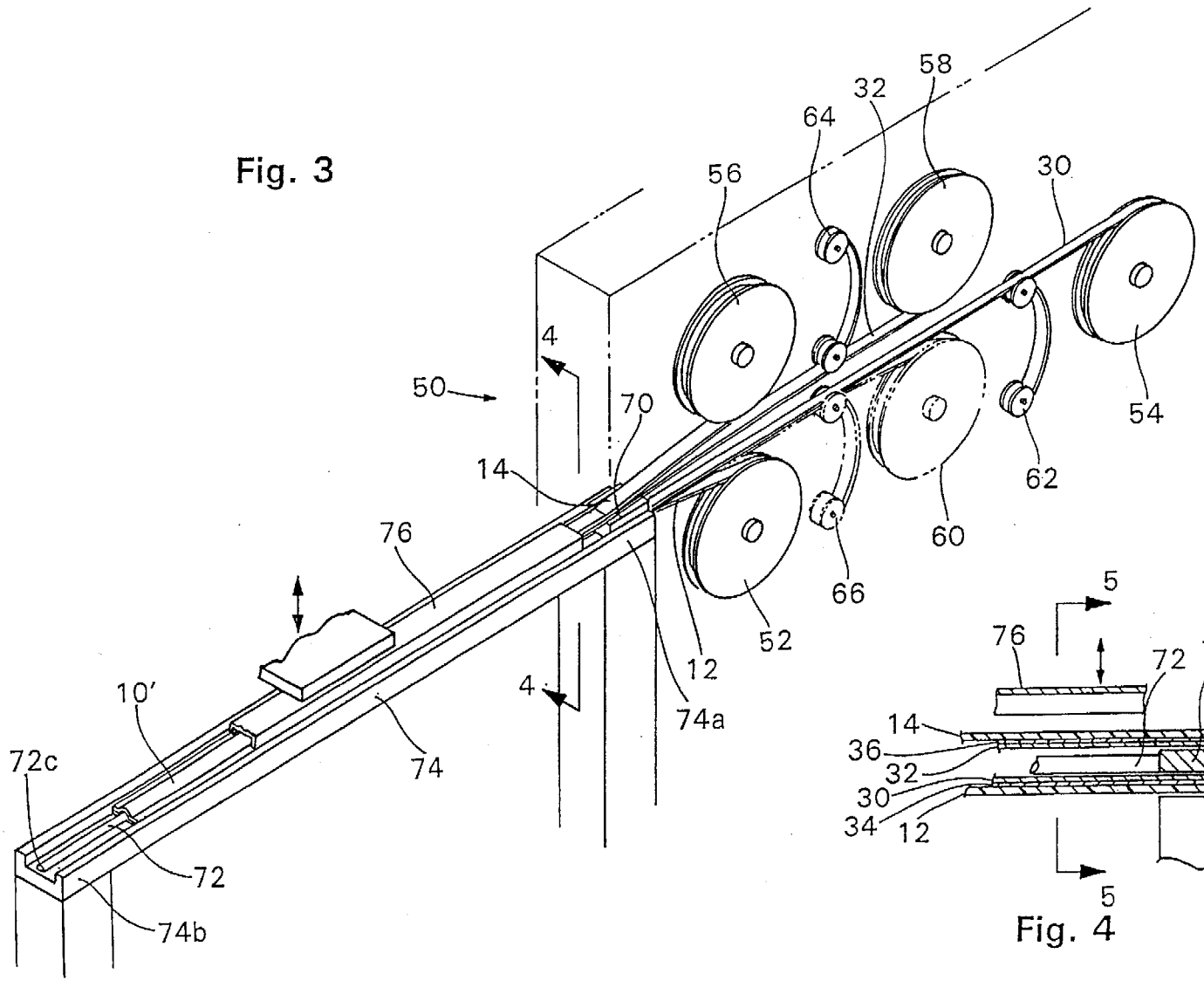
FIG. 3 is a perspective view of an apparatus for producing a continuous linear contact switch in accordance with the present invention.
Figure 4:
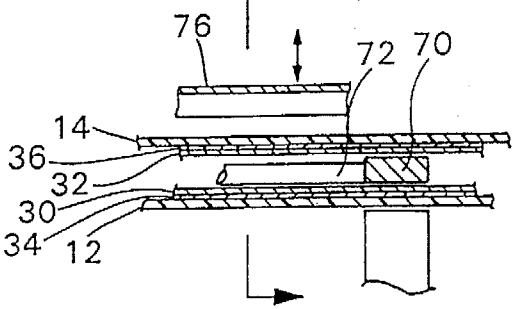
FIG. 4 is a cross-sectional view taken along line 4—4 in FIG. 3.

Referring now to FIGS. 3, 4 and 5*a*, a continuous linear contact switch forming apparatus 50 is shown. The contact switch forming apparatus 50 includes a plurality of feed rolls 52, 54, 56, 58 which supply the continuous first and second resilient strips 12 and 14 and first and second flexible, electrically conductive strips 30 and 32, respectively. More particularly, the first feed roll 52 provides a continuous supply of material for the first resilient strip 12, the second feed roll 54 provides a continuous supply of material for the first flexible, electrically conductive strip 30, the third feed roll 56 provides a continuous supply material for the second resilient strip 14, and the fourth feed roll 58 provides a continuous supply of material for the second, flexible electrically conductive strip 32. Preferably, the feed rolls 52, 54, 56, 58 are mounted for rotary movement, and replaceable rolls of the designated materials can be installed on and removed from the feed rolls 52, 54, 56, 58 in a manner known to those of ordinary skill in the art.

Still with reference FIG. 3, adhesive supply rolls 62 and 64 are provided for the adhesive material layers 34 and 36 which adhere the first and second flexible, electrically conductive strips 30, 32 to the inner surfaces 12*d*, 14*d* of the first and second resilient strips 12 and 14 respectively.

A track 74 is provided adjacent to the feed rolls 52, 54, 56, and 58 for receiving the continuous strips of resilient material 12, 14 and forming the seams 16, 18 along the longitudinal edges 12*a*, 14*a* and 12*b*, 14*b* thereof. An RF seal bar 76 is mounted for upward and downward movement above the track 74. A forming mandrel 72 is cantilevered from a support 70 located at a first end 74*a* of the track 74, adjacent to the feed rolls 52, 54, 56 and 58. The forming mandrel 72 has a first, generally flat side 72*a* and a second, rounded side 72*b*. The free end 72*c* of the mandrel 72 is located adjacent to the second end 74*b* of the track 74.

Referring now to FIGS. 3 and 4, the first strip of flexible, electrically conductive material 30 is fed toward the first end 74*a* of the track 74 from the second feed roll 54, and the first adhesive layer 34 is applied to the first strip of flexible, electrically conductive material 30 from the first adhesive supply roll 62. The first flexible, electrically conductive strip 30 is then fed to an area adjacent to the first resilient strip 12, which is fed from the first feed roll 52 such that the adhesive layer 34 bonds the first strip of flexible, electrically conductive material 30 to the inner surface 12*d* of the first resilient strip 12. The first resilient strip 12 and the attached first flexible, electrically conductive strip 30 are fed beneath the support 70. A portion of the continuous first strip of resilient material 12, with the first strip of flexible, electrically conductive material 30 affixed to the inner surface 12*c* thereof, is then located on the first side 72*a* of the forming mandrel 72 in the track 74, as shown in detail in FIG. 5*a*.

The second strip of flexible, electrically conductive material 32 is fed from the fourth feed roll 58 toward the first end of the track 74, and the second layer of adhesive 36 is applied to the second strip of flexible, electrically conductive material 32 from the second adhesive supply roll 64. The second strip of flexible, electrically conductive material 32 is then fed to an area adjacent to the second resilient strip 14, which is fed from the third feed roll 56, such that the second adhesive layer 36 bonds the second strip of flexible, electrically conductive material 32 to the inner surface 14*d* of the second resilient strip 14. The second resilient strip 14 and the attached second flexible, electrically conductive strip 32 are fed over the support 70 and a portion of the second strip of resilient material 14, with the attached second strip of flexible, electrically conductive material 32, is located on the second side 72*b* of the mandrel 72. The RF seal bar 76 is then moved downwardly to press the first and second longitudinal edges 14*a*, 14*b* of the second strip of resilient material 14 against the first and second longitudinal edges 12*a*, 12*b* of the first strip of resilient material 12. For purposes of illustration in FIG. 5*a*, the second strip of resilient material 14 and the RF seal bar 76 have been illustrated as being spaced from the mandrel 72 and the lower track 74. However, preferably, the RF seal bar 76 and the second strip of resilient material 14 are located in close proximity to the mandrel 72 so that the first and second longitudinal edges 14*a*, 14*b* of the second resilient strip 14 are maintained in position.

The RF seal bar 76 is then closed and current is applied such that the first and second longitudinal edges 12*a*, 12*b* of the portion of the first longitudinal strip 12 located on the first side 72*a* of the mandrel 72 are joined with respective first and second longitudinal edges 14*a*, 14*b* of the second longitudinal strip 14 located on the second side 72*b* of the mandrel 72 to form a portion 10' of the linear contact switch 10, as shown in FIG. 3. Preferably, the first and second resilient strips 12, 14 are joined along the longitudinal edges 12*a*, 12*b*, 14*a*, 14*b* by the pressure and vibration of the RF seal bar to form the first and second seams 16 and 18.

As shown in FIG. 5*a*, in the first embodiment, preferably the beads 20 and 22 are pre-formed on the first strip of resilient material 12 and provide a contact area for the first and second longitudinal edges 14*a*, 14*b* of the second strip of resilient material 14 to be attached.

After the first and second seams 16 and 18 are formed along the portion of the first and second longitudinal strips 12 and 14 located in proximity to the mandrel 72, the RF seal bar 76 is raised and the now seamed portion 10' of the continuous linear contact switch 10 is slid off the free end 72*c* of the mandrel 72, as shown in FIG. 3. Additional portions of the first and second strips 12 and 14 with the attached first and second strips of flexible, electrically conductive material 30, 32 are simultaneously fed from the feed rolls 52, 54, 56 and 58 and located on the first and second sides 72*a* and 72*b* of the mandrel 72, respectively. By repeating the process, a continuous length of linear contact switch 10 can be formed with the only limitations on the length of the contact switch 10 being the length of the continuous strips of material 12, 14, 30, 32 on the feed rolls 52, 54, 56, 58.

In the second preferred embodiment of the continuous linear contact switch, a fifth feed roll 60 (shown in phantom) is provided to supply material for the stiffening member 112. A third adhesive supply roll 66 (shown in phantom) is also provided to supply a third layer of adhesive 114 to attach the stiffening member 112 to the first resilient strip 12. After the stiffening member 112 is attached to the first resilient strip 12, the first strip of flexible, electrically conductive 30 is attached to the stiffening member 112 prior to being fed under the support 70. A portion of the first resilient strip 12, with the attached stiffening member 112 and the first strip of flexible, electrically conductive material, is then located on the first side 72*a* of the mandrel 72, as shown in FIG. 5*b*. The remainder of the process is the same as that described above in connection with the first embodiment 10, except that the beads 20 and 22 are formed by the pressure between the seal bar 76 and the support track 74 acting on the first and second resilient strips 12, 14 which forces material from the first and second resilient strips 12, 14 to move or extrude inwardly into the cavity 26 along the juncture of the first and second longitudinal edges 12*a*, 12*b*, 14*a*, 14*b* of the strips 12, 14 to form the beads 20, 22.

In the preferred embodiment, the mandrel 72 and the RF seal bar 76 are approximately three feet long, and approximately three feet of the linear contact switch 10, 110 can be formed at one time prior to sliding the seamed linear contact switch portion off the mandrel 72 and indexing additional material to the RF sealing position. It is understood from the present disclosure that the length of the RF seal bar 70 may vary, along with the lengths of the mandrel 72 and the support track 74, and may be shorter or longer, if desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A continuous linear contact switch comprising:

first and second resilient strips, each having first and second longitudinal edges, an outer surface and an inner surface, the respective first and second longitudinal edges of the first and second resilient strips being joined to each other at first and second seams along an entire longitudinal length thereof;

beads located along the seams on the inner surfaces of at least one of the first and second resilient strips so that the first resilient strip remains generally flat and the second resilient strip is arched, to form an inner cavity between the generally flat first resilient strip and the arched second resilient strip;

a first flexible, electrically conductive strip located on the inner surface of the first resilient strip; and a second flexible, electrically conductive strip located on the inner surface of the second resilient strip, the second flexible, electrically conductive strip being spaced from the first flexible, electrically conductive strip.

2. The continuous linear contact switch of claim 1 further comprising a pre-formed bead located along each of the first and second longitudinal edges of the first resilient strip.

3. The continuous linear contact switch of claim 1 wherein the beads are formed as the seams are being formed between the first and second resilient strips.

4. The continuous linear contact switch of claim 1 further comprising a stiffening member located between the first strip of flexible, electrically conductive material and the first resilient strip.

5. The continuous linear contact switch of claim 1 wherein each seam comprises a radio frequency seal.

6. A continuous linear contact switch comprising:

first and second resilient strips, each having first and second longitudinal edges, an outer surface and an inner surface, the respective first and second longitudinal edges of the first and second resilient strips being connected to each other along an entire longitudinal length thereof;

beads located on the inner surface of the first resilient strip along the first and second longitudinal edges thereof adjacent to the first and second longitudinal edges of the second resilient strip, the second resilient strip being arched to form an inner cavity between the first and second resilient strips with the beads being located inside the cavity;

a first flexible, electrically conductive strip located on the inner surface of the first resilient strip; and a second flexible, electrically conductive strip being located along the inner surface of the second resilient strip, the beads maintaining a gap between the first and second flexible, electrically conductive strips.

7. The continuous linear contact switch of claim 6 wherein the first and second strips are joined along the first and second longitudinal edges by seams and the beads are formed as the seams are being formed.

8. The continuous linear contact switch of claim 7 wherein each seam comprises a radio frequency seal.

9. The continuous linear contact switch of claim 6 further comprising a stiffening member located between the first strip of flexible, electrically conductive material and the first resilient strip.

10. A method of assembling a continuous linear contact switch comprising the steps of:

locating a portion of a first strip of resilient material, having first and second longitudinal edges, an outer surface and an inner surface, with a first strip of flexible, electrically conductive affixed to the inner surface, on a first side of a mandrel;

locating a portion of a second strip of resilient material, having first and second longitudinal edges, an outer surface and an inner surface, with a second strip of flexible, electrically conductive affixed to the inner surface of the second strip, on a second side of the mandrel;

joining the first and second longitudinal edges of the portion of the first longitudinal strip located on the first side of the mandrel with the respective first and second edges of the second longitudinal strip located on the second side of the mandrel to form a portion of a continuous linear contact switch;

removing the portion of the linear contact switch from the mandrel; and locating additional portions of the first and second continuous resilient strips, with the attached first and second strips of flexible, electrically conductive material, on the first and second sides of the mandrel and joining the respective first and second longitudinal edges together to form a continuous linear contact switch of a desired length.

* * * * *